US009472076B2

(12) United States Patent
Hovang

(10) Patent No.: US 9,472,076 B2
(45) Date of Patent: Oct. 18, 2016

(54) METHOD AND A SYSTEM FOR SUPERVISING INTRUDER ALARM SYSTEMS

(75) Inventor: Dan Hovang, Sjobo (SE)

(73) Assignee: SECURITAS DIRECT AB, Malmo (SE)

( * ) Notice: Subject to any disclaimer, the term of this patent is extended or adjusted under 35 U.S.C. 154(b) by 178 days.

(21) Appl. No.: 14/117,450

(22) PCT Filed: Jun. 29, 2012

(86) PCT No.: PCT/EP2012/062687

§ 371 (c)(1),
(2), (4) Date: Nov. 24, 2014

(87) PCT Pub. No.: WO2013/004613

PCT Pub. Date: Jan. 10, 2013

(65) Prior Publication Data

US 2015/0070167 A1 Mar. 12, 2015

(30) Foreign Application Priority Data

Jul. 1, 2011 (EP) ..... 11172384

(51) Int. Cl.
*G08B 13/00* (2006.01)
*G08B 13/24* (2006.01)
(Continued)

(52) U.S. Cl.
CPC ..... *G08B 13/2491* (2013.01); *G08B 25/009* (2013.01); *G08B 25/10* (2013.01); *G08B 29/16* (2013.01)

(58) Field of Classification Search
CPC ..... F16C 32/0442; F16C 32/0446; F16C 32/0476; F16C 35/00; F16C 37/005; F16C 39/02; A61B 3/0285; A61B 6/4258; A61F 2/1624; B22C 9/04; B23P 15/246; B29C 33/301; B29C 33/38; B29C 33/3835
USPC ..... 340/541, 565, 567, 566, 501, 517, 521, 340/522, 506, 552, 531, 547, 545.1, 551, 340/635
See application file for complete search history.

(56) References Cited

U.S. PATENT DOCUMENTS 4,660,024 A * 4/1987 McMaster ..... G08B 13/1645 340/506

(Continued)

FOREIGN PATENT DOCUMENTS

| | | | |
|---|---|---|---|
| GB | 2457102 | A | 8/2009 |
| RU | 2399095 | C1 | 9/2010 |
| WO | 2004010398 | A1 | 1/2004 |

OTHER PUBLICATIONS

"3rd Generation Partnership Project; Technical Specification Group Services and System Aspects; General Packet Radio Service (GPRS) enhancements for Evolved Universal Terrestrial Radio Access Network (E-UTRAN) access (Release 11)", vol. SA WG2, No. V11.0.0, pp. 1-287, XP050554520, 3GPP Standard; 3GPP TS 23.401, 20111214 3rd Generation Partnership Project (3GPP), Mobile Competence Centre; 650, route des Lucioles; F-06921 Sophia-Antipolis Cedex; France.

(Continued)

*Primary Examiner* — Daniel Previl
(74) *Attorney, Agent, or Firm* — Fredrickson & Byron, P.A.

(57) ABSTRACT

A method of supervising intruder alarm systems, each alarm system comprising a plurality of alarm sensors and at least one gateway communicating with a remote alarm receiving center. The method includes the steps: a) receiving in a first intruder alarm system radio signals transmitted from a second intruder alarm system, b) transmitting from said first intruder alarm system information relating to the received radio signals to said remote alarm receiving center, c) analysing in said remote alarm receiving center information received from intruder alarm systems to identify at least one first intruder alarm system and at least one second intruder alarm system capable of exchanging information via radio signals, d) transmitting from said remote alarm receiving center control signals to said first intruder alarm system and to said second intruder alarm system to operate as a supervising system by monitoring radio signals from the other intruder alarm system operating as a supervised system, e) observing in either one of said first intruder alarm system and said second intruder alarm system absence of the monitored radio signals, and f) transmitting from a supervising alarm system an alarm signal when absence of said monitored signals is detected.

15 Claims, 1 Drawing Sheet

(51) Int. Cl.

| | |
|---|---|
| ***G08B 25/00*** | (2006.01) |
| ***G08B 25/10*** | (2006.01) |
| ***G08B 29/16*** | (2006.01) |

(56) References Cited

U.S. PATENT DOCUMENTS

| | | | | |
|---|---|---|---|---|
| 4,821,027 | A * | 4/1989 | Mallory | H04M 11/045 340/506 |
| 5,093,656 | A * | 3/1992 | Dipoala | G01S 7/4052 340/515 |
| 6,570,496 | B2 | 5/2003 | Britton | |
| 6,895,082 | B2 | 5/2005 | Parker | |
| 8,022,843 | B2 | 9/2011 | Mitchell et al. | |
| 8,410,923 | B2 * | 4/2013 | Wang | G08B 25/14 340/539.1 |
| 2003/0067889 | A1 | 4/2003 | Petite | |
| 2004/0212503 | A1 | 10/2004 | Stilp | |
| 2005/0275528 | A1 | 12/2005 | Kates | |
| 2006/0132301 | A1 * | 6/2006 | Stilp | G05B 9/03 340/539.22 |
| 2006/0132303 | A1 | 6/2006 | Stilp | |
| 2008/0019313 | A1 | 1/2008 | Vogety | |
| 2009/0058630 | A1 * | 3/2009 | Friar | G08B 25/08 340/506 |
| 2009/0201866 | A1 | 8/2009 | Watteyne et al. | |
| 2009/0252032 | A1 | 10/2009 | Jiang et al. | |
| 2010/0257584 | A1 | 10/2010 | Meenan et al. | |
| 2011/0141884 | A1 | 6/2011 | Olsson et al. | |
| 2011/0261795 | A1 | 10/2011 | Honegger et al. | |

OTHER PUBLICATIONS

"3rd Generation Partnership Project; Technical Specification Group Services and System Aspects; System Improvements for Machine-Type Communications (Release 11)", vol. SA WG2, No. V1.6.1, pp. 1-165, XP050555302, 3GPP Standard; 3GPP TR 23.888, 20120305 3rd Generation Partnership Project (3GPP), Mobile Competence Centre; 650, route des Lucioles; F-06921 Sophia-Antipolis Cedex; France.

"3rd Generation Partnership Project; Technical Specification Group Core Network and Terminals; Mobile radio interface Layer 3 specification; Core network protocols; Stage 3 (Release 11)", vol. CT WG1, No. V11.1.2, pp. 1-653, XP050555167, 3GPP Standard; 3GPP TS 24.008, 20120105 3rd Generation Partnership Project (3GPP), Mobile Competence Centre; 650, route des Lucioles; F-06921 Sophia-Antipolis Cedex; France.

International Search Report dated Jul. 17, 2013 for Intl. Pat. Application No. PCT/EP2013/054712, 3 pages, European Patent Office, Rijswijk, The Netherlands.

International Search Report dated Jul. 1, 2013 for Intl. Pat. Application No. PCT/EP2013/054713, 3 pages, European Patent Office, Rijswijk, The Netherlands.

International Search Report dated Oct. 4, 2013 for Intl. Pat. Application No. PCT/EP2013/054747, 4 pages, European Patent Office, Rijswijk, The Netherlands.

Written Opinion of the International Searching Authority dated Oct. 4, 2013 for Application No. PCT/EP2013/054747, 6 pages, European Patent Office, Rijswijk, The Netherlands.

International Search Report dated Aug. 16, 2013 for Intl. Pat. Application No. PCT/EP2013/054752, 3 pages, European Patent Office, Rijswijk, The Netherlands.

International Search Report dated Aug. 20, 2013 for Intl. Pat. Application No. PCT/EP2013/054760, 4 pages, European Patent Office, Rijswijk, The Netherlands.

PCT International Search Report for Intl. App. No. PCT/EP2012/062687, from which the instant application is based, 3 pgs.

* cited by examiner

METHOD AND A SYSTEM FOR SUPERVISING INTRUDER ALARM SYSTEMS

RELATED APPLICATIONS

This application is a 35 U.S.C. 371 national stage filing from International Application No. PCT/EP2012/062687 filed Jun. 29, 2012 and claims priority to European Application No. 11172384.7 filed Jul. 1, 2011, the teachings of which are incorporated herein by reference.

TECHNICAL FIELD

The invention relates to a method and a system for supervising intruder alarm systems.

Alarm systems comprising detectors and gateways are commonly used in private houses and office premises. Alarm detectors more and more frequently are connected through wireless communication means to a base unit or gateway which in turn is connected to a central monitoring station such as a remote alarm receiving centre. In case of an alarm situation the alarm detector transmits an alarm signal to the gateway and the gateway transmits an alarm signal to the central monitoring station, should the alarm system be in an armed state.

PRIOR ART

Prior art remote control devices exist in different forms. Detectors, sensors and gateways normally communicate via radio links or by other wireless means. Radio signals also can be used for communication with the remote alarm receiving centre. As in all applications radio signals are vulnerable to disturbances and of course to deliberate jamming attempts.

GB2457102 discloses an alarm comprising a repeater which is arranged to detect a jamming signal and to transmit a jamming alert signal at a frequency other than a jammed frequency in the event that a jamming signal is detected.

Another way of handling jamming problems is to supply different channels, radio frequencies or wireless methods that can be used when a regular route is disturbed or jammed. Such a system is disclosed in RU2399095. The system in RU2399095 comprises a plurality of microcells in a multilevel hierarchical structure. A plurality of relay nodes is used to ensure that alarm messages are transmitted even if one microcell is jammed.

The prior art systems described above are based on the provision on redundant components that will increase the system complexity and the costs for implementation thereof. It would be desirable to provide a more simple and efficient system.

SUMMARY OF THE INVENTION

An object of the present invention is to avoid the drawbacks set out above and to provide an improved method of supervising intruder alarm systems, each alarm system comprising a plurality of components such as alarm sensors and at least one gateway communicating with a remote alarm receiving centre, wherein at least one alarm sensor communicates via a first radio link with said gateway.

In accordance with the invention each system communicates internally by transmitting information, or discovery, packets that contain system specific data such as the identity of the system and the identity of individual components of the system. In various embodiments the identity of a system corresponds to a subscriber identity while in other embodiments the identity of a system is associated to a subscriber identity that is known by the server only. When two systems are located in the vicinity of each other discovery packets transmitted in a first system may be received by a second system.

Upon receiving such discovery packets the second system transmits a notification message to the remote alarm receiving centre. The notification message may contain information regarding identity of the first system, receiver signal strength. The remote alarm receiving centre comprises a server and a database. The server stores information received from alarm systems in a database and determines alarm systems that are capable of supervising each other. A major factor of course is the ability of a second alarm system to receive radio signals exchanged within a first alarm system. In various embodiments more than two alarm systems may be interconnected in this way.

When the server of the remote alarm receiving centre has determined that two specific alarm systems are capable of supervising each other instructions are sent from the server to each one of the alarm systems. In various embodiments such instructions are received and stored in the gateway of the alarm systems. Alarm systems that are supervising each other are referred to as supervisors. After receiving supervising instructions from the server each alarm system initiates a supervising process. The supervising process is based on predictability of the involved alarm systems.

The supervising process includes transmitting radio signals from each supervisor and receiving radio signals sent from another supervisor or a plurality of other supervisors. In case an expected radio signal from a first supervisor is not received by a second supervisor the second supervisor informs the server of the remote alarm receiving centre that the first supervisor does not operate properly. One reason for not operating properly can be that a third party is disturbing the radio signals of the first supervisor alarm system for instance by a jamming operation.

After receiving information about a malfunctioning alarm system the remote alarm receiving centre may take various further steps to check the status of the alarm system and to produce alert or alarm signals. The suggested supervising system does not require installation of any redundant hardware or provision of alternative communication channels or frequencies. Instead existing hardware used in an alarm system is used. Communication is established and maintained through existing channels.

In various embodiments the instructions sent from the server to the supervisors include information showing identities of the alarm systems, threshold values of signal strength and optionally accepted noise levels and supervision schedules and frequencies. All information exchanged preferably is encrypted. Digital signatures are used for authentication control and replay protection. Further advantageous features and improvements are described below.

BRIEF DESCRIPTION OF THE DRAWINGS

In order that the manner in which the above recited and other advantages and objects of the invention are obtained will be readily understood, a more particular description of the invention briefly described above will be rendered by reference to specific embodiments thereof which are illustrated in the appended drawings.

Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
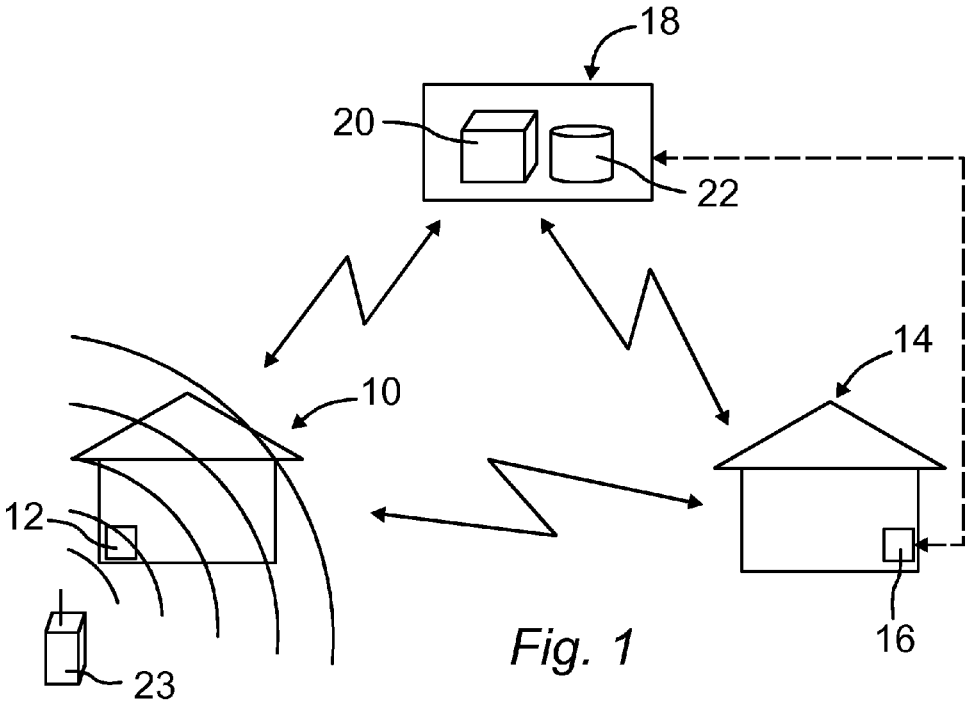
FIG. 1 is a schematic perspective view of an installation including one embodiment of a system in accordance with the invention.
Figure 2:
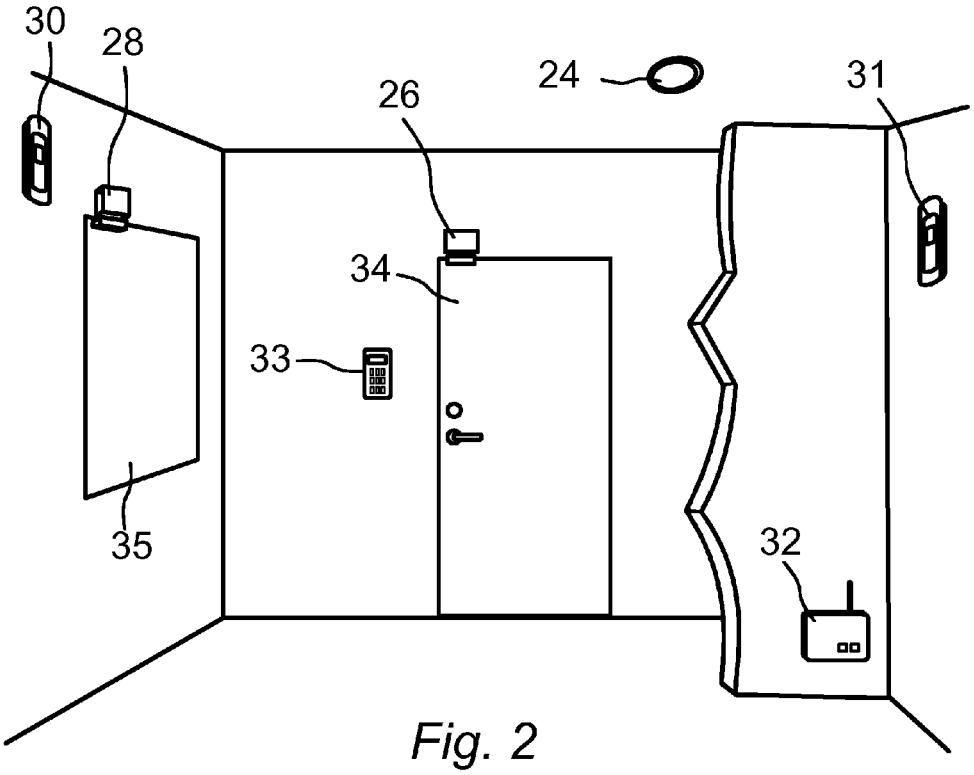
FIG. 2 is a schematic block diagram of an installation including an embodiment of the invention as shown in FIG. 1 and an associated central monitoring station.

The installation shown in FIG. 1 comprises a first alarm system 10 having a first gateway 12 and a second alarm system 14 having a second gateway 16. Both alarm systems basically are arranged in a conventional manner as shown in FIG. 2. Different systems may comprise different detectors and one or a plurality of gateways. During normal conditions the alarm systems operates separately. If any detector is triggered an alarm signal is sent to a remote alarm receiving centre 18 and further appropriate action is taken. Normally, no consideration regarding possibilities of or conditions for supervision needs to be taken during installation.

Alarm signals normally are sent by wireless communication but it is possible also to use wire as indicated in FIG. 1. Normally, the wireless communication between an alarm system and the remote alarm receiving centre 18 is based on existing communications infrastructure, such as GSM, GPRS, ADSL, broadband fibre or a similar communication system. The detectors used in the alarm systems normally are wireless and based on radio transmission. First alarm system 10 and second alarm system 14 are located in the vicinity of each other and radio signals transmitted from one system to some extent will be received in the other system.

When an alarm system receives radio signals from another alarm system signal strength of the radio signal and other signal properties are examined. If relevant information such as the identity of the other alarm system components can be determined a report message is transferred to the remote alarm receiving centre 18. The report message comprises identity information and technical information such as signal strength and signal quality and of course system identity information of the transmitting party.

A server 20 of the remote alarm receiving centre 18 analyses the received information and determines whether it is sufficient for starting a supervising process. One step performed by the server can be to associate the system identity information to a specific subscriber identity. A predefined set of rules can be applied in the decision-making process including preferences and conditions related to each subscriber identity. The server also maintains information regarding present status of systems and information relating to maintenance or service measures and may exclude systems that presently are not available. In various embodiments also adaptive functions are implemented to allow the server 20 to modify settings in the supervising process. The server 20 also stores information about the involved alarm systems and the applied settings in a database 22.

It should be noted that a substantial part of the radio signalling within an alarm system is encrypted. No sensitive information regarding subscriber identity, system configuration or any other relevant information can be obtained by a third party.

After determining a supervising process any information necessary for applying it is transmitted to the involved alarm systems. Such information comprises identity information that is required for each of the involved alarm systems to analyse received radio signals. Predictability of the involved alarm systems can be monitored by including in the information a schedule or plan for sending messages that are received by a receiving alarm system. The messages can be specifically defined for use in the supervising process. In various embodiments the messages comprise data that normally is transmitted within an alarm system. At least one alarm system will become a supervising system and at least one alarm system will become a supervised system. In various embodiments an alarm system may operate as a supervising system and a supervised system at the same time. One supervising system also may supervise a plurality of other alarm systems.

Furthermore, the information from the server 20 may also comprise radio threshold values. These threshold values are used in an alarm system for detecting jamming attempts or other disturbing radio signals. Each alarm system normally has to consider a noise level caused by radio signals present in the environment. During normal conditions the noise level has to be taken into account but all radio signalling used by the alarm systems can be handled in a secure way.

If the noise level as detected by the first alarm system or by the second alarm system is increased over the threshold value an attempt to disturb the radio signalling may be at hand. Information regarding an increased noise level then can be forwarded to the server 20 to allow it to be alerted. Should there be also a dropout of the expected signals from a supervised alarm station a jamming attempt can be reported to the server 20.

If a jamming device 23 is activated in the vicinity of the first alarm system 10 radio signals within the alarm system as well as radio signals outside the alarm system will be disturbed. Normally radio signals intended for the remote alarm receiving centre no longer can be received. During these conditions the second alarm system 14 will notice an increased noise level and supervising signals that have failed to appear. As a result an alarm message is transmitted from the second alarm system 14 to the server 20. The alarm message comprises information associated with the identity of the first alarm system and status information.

In various embodiments a supervising system that detects absence of expected radio signals from a supervised system may attempt to contact the supervised system by sending an echo request or similar signal. If no acknowledge signal is received the alarm message will be sent to the server 20. If several alarm systems are supervising a non-responding supervised system the server may request that other supervising systems send echo request signals.

After receiving the alarm message the server 20 may take different action depending on present settings that apply for the first alarm system 10 and the second alarm system 14. In various embodiments the described situation will be handled as an intrusion attempt and normal steps for handling such a situation will be taken. By keeping record of maintenance schedules and other controlling information in the server 20 received alarm signals from supervising systems can be ignored or handled differently and in view of the present status of a supervised alarm system.

A basic alarm installation as shown in FIG. 2 includes a plurality of wireless alarm detectors, including a smoke detector 24, a first perimeter alarm detector 26, a second perimeter alarm detector 28 and a first infrared detector 30 or similar photodetector. Smoke detector 24 and detectors for gas or water leakage are constantly activated. The first infrared detector 30 is an interior detector.

Alarm signals from the detectors are transmitted to a wireless control panel or gateway 32. Detectors and the gateway form an alarm system. When the alarm system is armed the gateway will transmit an alarm signal to a remote alarm receiving centre and normally also generate a sound alarm when an alarm signal from a detector is received. The smoke detector 24 is always armed. Arming of the system normally is requested using a keypad 33 arranged by the door 34.

The smoke detector 24 is mounted in the ceiling of the premises and the infrared detector 28 is mounted on a wall. The first perimeter alarm detector 26 is installed above a door 34 to detect when the door is opened. A corresponding second perimeter alarm detector 28 is installed by a window 35. In the shown embodiment the keypad 33 is arranged by the door 34. The gateway 32 is mounted in a room separated from the entrance of the premises. In the shown embodiment a second infrared detector 31 is arranged to cover the gateway 32, so as to ensure that an intruder cannot tamper with the gateway 32 when the system is armed. The second infrared detector 31 is an interior detector.

In various embodiments radio signals exchanged within a first alarm system during standard operation can be received also by a second alarm system. Standard operation radio signals are transmitted from each of the detectors and from the gateway. In various embodiments the gateway can be arranged to transmit a different set of supervising signals that can be received at another alarm system. The different set of supervising signals can be broadcasted at higher signal strength levels so as to facilitate the supervising functionality and to improve an operational distance between supervising alarm systems.

While certain illustrative embodiments of the invention have been described in particularity, it will be understood that various other modifications will be readily apparent to those skilled in the art without departing from the scope and spirit of the invention. Accordingly, it is not intended that the scope of the claims appended hereto be limited to the description set forth herein but rather that the claims be construed as encompassing all equivalents of the present invention which are apparent to those skilled in the art to which the invention pertains.

The invention claimed is:

1. A method of supervising intruder alarm systems, each alarm system comprising a plurality of alarm sensors and at least one gateway communicating with a remote alarm receiving center, wherein at least one alarm sensor communicates via a first radio link with said gateway, said method comprising the steps:

a) receiving in a first intruder alarm system radio signals transmitted from a second intruder alarm system, b) transmitting from said first intruder alarm system information relating to the received radio signals to said remote alarm receiving center, c) analysing in said remote alarm receiving center information received from intruder alarm systems to identify at least one first intruder alarm system and at least one second intruder alarm system capable of exchanging information via radio signals, d) transmitting from said remote alarm receiving center control signals to said first intruder alarm system to operate as a supervising system by monitoring radio signals from said at least one second intruder alarm system operating as a supervised system; and to said at least one second intruder alarm system to operate as a supervising system by monitoring radio signals from said first intruder alarm system operating as a supervised system, e) observing in either one of said first intruder alarm system and said second intruder alarm system absence of the monitored radio signals, and f) transmitting from a supervising alarm system an alarm signal when absence of said monitored signals is detected.

2. A method as claimed in claim 1, also comprising the step:

receiving in a first intruder alarm system radio signals exchanged within a second intruder alarm system.

3. A method as claimed in claim 2, also comprising the step:

maintaining in the remote alarm receiving center records of alarm system identities and associated subscriber information, so as to be able to avoid exchanging subscriber information during communication between said remote alarm receiving center and intruder alarm systems.

4. A method as claimed in claim 1, also comprising the steps:

including in said control signals instructions to send specifically defined messages, and receiving in a supervising alarm system radio signals comprising said specifically defined messages sent from a supervised alarm system.

5. A method as claimed in claim 4, also comprising the step:

including in said control signals monitoring instructions based on a predictable time schedule for sending and receiving radio signals.

6. A method as claimed in claim 5, also comprising the steps:

including in said control signals threshold values of background noise levels, measuring background noise levels in said intruder alarm systems, and generating an alarm message in any intruder alarm system detecting background noise levels exceeding said threshold values.

7. A method as claimed in claim 6, also comprising the steps:

including in said control signals instructions to an alarm system to send echo request signals from a supervising system to a supervised system, and generating an alarm message in a supervising alarm system not receiving an acknowledge signal from a supervised system.

8. A method as claimed in claim 4, also comprising the step:

maintaining in the remote alarm receiving center records of alarm system identities and associated subscriber information, so as to be able to avoid exchanging subscriber information during communication between said remote alarm receiving center and intruder alarm systems.

9. A method as claimed in claim 1, also comprising the step:

including in said control signals monitoring instructions based on a predictable time schedule for sending and receiving radio signals.

10. A method as claimed in claim 1, also comprising the steps:

including in said control signals threshold values of background noise levels, measuring background noise levels in said intruder alarm systems, and generating an alarm message in any intruder alarm system detecting background noise levels exceeding said threshold values.

11. A method as claimed in claim 10, also comprising the steps:

including in said control signals instructions to an alarm system to send echo request signals from a supervising system to a supervised system, and generating an alarm message in a supervising alarm system not receiving an acknowledge signal from a supervised system.

12. A method as claimed in claim 10, also comprising the steps:

receiving in a first gateway of a first intruder alarm system radio signals transmitted from a second gateway of a second intruder alarm system to alarm sensors included in said second intruder alarm system, and transmitting from said first intruder alarm system information relating to the received radio signals to said remote alarm receiving center.

13. A method as claimed in claim 1, also comprising the steps:

including in said control signals instructions to an alarm system to send echo request signals from a supervising system to a supervised system, and generating an alarm message in a supervising alarm system not receiving an acknowledge signal from a supervised system.

14. A method as claimed in claim 13, also comprising the steps:

receiving in a first gateway of a first intruder alarm system radio signals transmitted from a second gateway of a second intruder alarm system to alarm sensors included in said second intruder alarm system, and transmitting from said first intruder alarm system information relating to the received radio signals to said remote alarm receiving center.

15. A method as claimed in claim 1, also comprising the steps:

maintaining in the remote alarm receiving center records maintenance schedules and similar information regarding intruder alarm systems, and utilizing said information when receiving alarm signals to avoid unnecessary alarm activities.

* * * * *